United States Patent [19]

Miller

[11] 4,222,841

[45] Sep. 16, 1980

[54] HALL CELL

[75] Inventor: John J. Miller, San Mateo, Calif.

[73] Assignee: Alumax Inc., San Mateo, Calif.

[21] Appl. No.: 32,357

[22] Filed: Apr. 23, 1979

[51] Int. Cl.[2] ..... C25C 3/22

[52] U.S. Cl. ..... 204/247; 204/274

[58] Field of Search ..... 204/67, 243 R–247, 204/274

[56] References Cited

U.S. PATENT DOCUMENTS

| | | | |
|---|---|---|---|
| 1,534,322 | 4/1925 | Hoopes et al. | 204/245 X |
| 1,855,351 | 4/1932 | Hunter | 204/243 R |
| 3,580,835 | 5/1971 | Peterson | 204/245 X |
| 3,607,685 | 9/1971 | Johnson | 204/67 |
| 4,045,309 | 8/1977 | Andersen | 204/67 |
| 4,049,511 | 9/1977 | Alder et al. | 204/67 |
| 4,133,727 | 1/1979 | Rogers | 204/243 R X |

*Primary Examiner*—John H. Mack
*Assistant Examiner*—D. R. Valentine
*Attorney, Agent, or Firm*—Limbach, Limbach & Sutton

[57] ABSTRACT

An improved aluminum reduction cell which includes an insulated container for the molten electrolyte, a cover over the open mouth of the container, and a heat exchanger positioned above the molten bath, within the container and below the cover for recovering heat from the molten bath and further including, in one embodiment, means for converting the recovered heat into electricity which can be recycled back to the reduction cell. By heavily insulating the reduction cell against heat loss and by appropriately controlling the amount of heat which is recovered the cell can be operated over a wide range of electrical power inputs.

7 Claims, 2 Drawing Figures

HALL CELL

BACKGROUND OF THE INVENTION

The present invention relates to aluminum smelting and, more particularly, to an improved aluminum reduction cell for recovering aluminum from $Al_2O_3$.

In the production of aluminum by the Hall process, direct current is passed through an electrolyte containing dissolved alumina. The molten electrolyte at a temperature of about 960° C. is contained within a steel shell, the bottom and sides of which are lined with carbonaceous material. Carbon anodes immersed in the molten electrolyte cover much of the surface of the electrolyte. The remainder of the surface is covered by a crust of alumina and frozen electrolyte.

The power required to convert alumina to aluminum amounts to about 2½ KWH per pound of aluminum. However, the electrical resistance of the electrolyte, the anode, the cathode and interconnecting conductors requires an additional 3½–4½ KWH/#. The extra power so supplied is transformed into heat which must be dissipated. The temperature of the electrolyte must be held as closely as possible to optimum—lower temperatures endangering freezing and cessation of operations—higher temperatures resulting in drastic reduction in production efficiencies. Thus a controlled emission of the heat being generated is essential to good operation.

As it is designed and operated, the conventional modern cell reflects an outmoded method of batch feeding the alumina and the outdated assumption of cheap energy. It was originally considered necessary to place the charge of alumina on the surface of the pot several hours before mixing it into the electrolyte in order to preheat it. This resulted in the formation on the surface of the electrolyte a crust which served to restrict the loss of heat and the emission of fluorides. A degree of control was afforded to the pot operator in that he could vary the thickness of the crust, the frequency of breaking it, and even the length of time the molten electrolyte was left exposed before fresh alumina was piled on. Undesirable features were the unmeasured variations introduced by these deliberate changes to say nothing of those from variations in the insulating qualities of alumina. Another variable is that the crust may supply a little or a lot of alumina to the electrolyte between scheduled feeding time. And finally, it is difficult to get a continuous temperature reading of the electrolyte for control purposes. The molten electrolyte is too corrosive to permit continuous immersion of a thermocouple and the crust inhibits a visual observation from about. All this contributes to the difficulty of automating the operation and explains some of the need for artistry in the operation.

The modern concept of feeding alumina is by continuous addition—by passing the preheating on the pot surface. A feeder repeatedly breaks a hole in the crust and alumina is dropped on to the exposed surface of the molten electrolyte. Thus, the crust has lost some of its purpose but continues to function variably in other aspects. In an apparatus described in U.S. Pat. No. 3,951,763, a cover is placed over the pot to contain the heat and to keep the upper surface of the bath in a molten condition. Alumina is continuously fed through the cover. In other respects, however, the pot or cell is more or less conventional.

To complete the picture, the walls and bottom of the conventional pot are designed to dissipate the heat which is not emitted through the surface. The bottom is reasonably well insulated although the collector bars carrying current from the bottom are good radiators of heat. However, the side and end walls are lightly insulated and the shell temperature reaches some 200° C. during operation.

The cell is thus designed to dissipate a specific quantity of heat—with a variation of some 10 percent possible through adjustment of the crust. With a reliable and continuous supply of power, this has proved to be a workable arrangement. Nevertheless, in case of a power interruption, the affected cells can be expected to freeze up in a few hours. If the power supply is reduced, the power requirements of operating cells can be reduced by some 10 percent—and any power shortage beyond that must be covered by letting the surplus cells freeze. The cost of repairing and restarting frozen cells is very high so that the fixed operating level is a real disadvantage when power is not firm. Thus the cells must be designed to operate over a relatively narrow range of available power inputs and even at normal power inputs a great deal of power is simply wasted in the form of dissipated resistive heating.

It may also be noted that although the crust restricts the emissions of fluorides from the surface of the electrolyte, it does not arrest them adequately. It has been necessary to install hoods over the surface to capture the gases produced by electrolysis and other particulate emissions. The vacuum applied to the hoods is intended to ensure a substantial inflow of air through the joints of the hoods so that collection of the pot emissions will be as perfect as possible. The hood flow is passed through bag filters and it is necessary that the temperature be low enough that it does not burn the fabric in the bags.

SUMMARY OF THE INVENTION

The above and other disadvantages of prior art aluminum reduction cells are overcome by the present invention of an improved aluminum reduction cell in which the walls of the cell container are heavily insulated and a heat resistant cover is placed over the open mouth of the container. A heat exchanger is positioned above the molten bath, within the container and beneath the cover for recovering heat from the molten bath. The rate of heat recovery by the heat exchanger is selectively controllable. In one embodiment of the invention, means are connected to this heat exchanger for converting the recovered heat into electricity. In one form of this embodiment the heat exchanger includes a heat transfer fluid which circulates through a steam boiler. The steam output from the boiler is used to run an electrical generator. In other embodiments the heat transfer fluid, in the form of an expandible gas, is heated in the exchanger to increase its pressure. The pressurized gas is then used directly to operate a turbine driven electrical generator. The power output from the electrical generator can, in some embodiments, be fed back to the electrical power supply for the cell. In this way heat is recovered and is recycled as electrical power.

Another heat exchanger is preferably placed around the exterior surface of the cell container to recover heat flow through the side, end and bottom walls of the container. Still another heat exchanger can be placed above the container mouth cover but below a fume hood which encompasses the whole top of the cell, thereby recovering heat which is produced in the anodes and which escapes between the anode and the main cover. These additional heat exchangers are connected in series with the primary heat exchange system.

In order to automatically regulate the amount of heat recovery through the heat exchangers, a temperature sensor is placed within the cell, but above the bath, for monitoring the electrolyte bath temperature. This sensor generates a control signal which is representative of the temperature and which is supplied to a controller connected to the heat exchangers to regulate the flow of the heat transfer fluid through them. Thus, the temperature of the electrolyte within the cell can be automatically maintained at a selected value.

It is therefore an object of the present invention to recover substantial quantities of wasted heat at a temperature high enough to generate electrical power.

It is another object of the invention to provide improved flexibility of reduction cell operations so that the present limitation of 90%–100% of production can be greatly extended.

It is still a further object of the invention to provide improved operating control for an aluminum reduction cell so that heat removal can be adjusted precisely to the generating rate.

It is yet another object of the invention to eliminate the crust which is formed on the molten aluminum bath to permit continuous measurement of the temperature of the baths.

It is still a further object of the invention to efficiently capture pot gases so that the amount of atmospheric air which is drawn into the scrubbing system is reduced.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENTS

Figure 1:
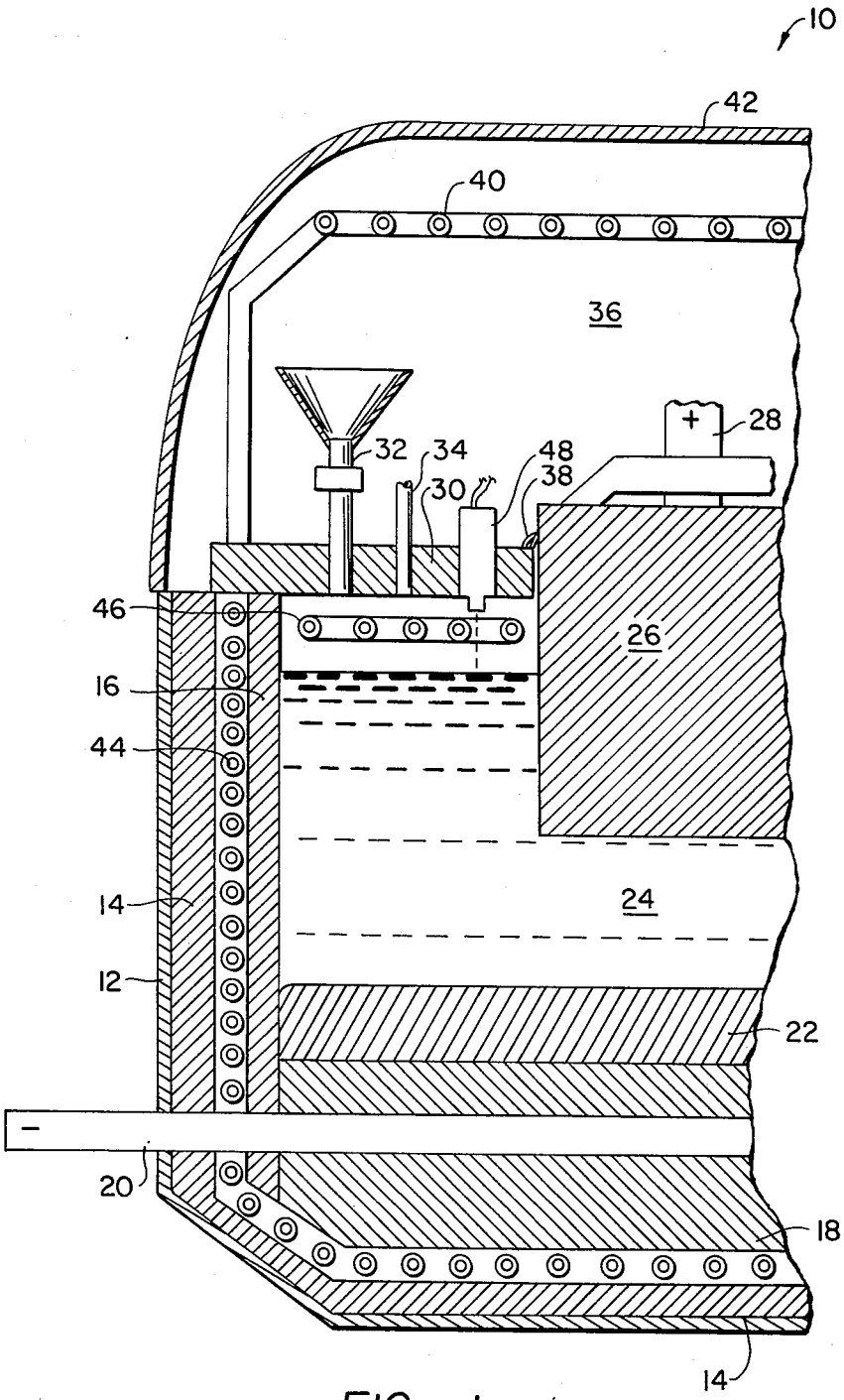
FIG. 1 is an elevational, cross sectional, broken away view of an aluminum reduction cell according to the invention.

In FIG. 1 is depicted schematically a Hall type electrolytic cell 10. It consists of an open top steel shell 12. The interior walls and bottom are lined with insulating material 14. Within the insulation is a carbonaceous lining 16 which contains the molten electrolyte and molten aluminum. On the bottom, this lining usually consists of prebaked blocks 18. Steel collector bars 20 cemented to these blocks protrude through the steel shell and connect to the electrical circuit.

A layer of molten aluminum 22 is maintained in the bottom of the cavity. Above the aluminum floats a layer of electrolyte 24 consisting of cryolite with aditives. A carbonaceous anode 26 is partially immersed in the electrolyte. Steel stubs 28 cemented to the anode are connected to the electrical circuit. Thus the current can flow to the stub 28, the anode 26, through the electrolyte 24 to the metal pad 22, the carbonaceous blocks 18 and out the collector bars 20 to the busbar (not shown).

A cover 30 made of refractory or carbonaceous material closely encompasses the anodes 26 and closes off the open space at the top of the cell around the anode. A feeder 32 to permit the controlled addition of alumina to the electrolyte extends through the cover 30. A vent pipe 34 to allow the escape of pot gases into the fume chamber 36 above also extends through the cover 30. The fume chamber 36 is covered by a fume hood 42 which is connected to a pot gas scrubbing system (not shown). Since the power source, the alumina feeder, and the fume chamber and hood are well known to those skilled in the art, their details will not be described.

The cover 30 abuts the anode 26 reasonably closely but there must be room for movement. The joint between the cover and the anode can be filled with crushed bath or alumina 38. The cover is also readily removable to facilitate the changing of anodes. Thus the cavity under the cover will cause most of the gases to flow through the vent 34 but the cover need not be elsewhere gas tight.

In order to both recover heat generated in the cell and to control its operating temperature, heat exchangers are installed in the fume chamber 36, in the cell between the carbonaceous lining 16 and the insulation 14 and below the cover 30 and above the surface of the electrolyte 24.

The heat exchangers are depicted as horizontal pipes but may be plates or any form of heat exchanger which provide the required heat exchange surface area and which are made of material satisfactory for the temperature conditions in that area.

The heat exchanger 40 above the cover 30 but below the fume hood 42 is in the lowest temperature zone (200° F. approximately) and is intended to pick up such heat from the vent gases and the surface of the anodes 26 and stubs 28 as may be of economic interest. The quantity of outside air drawn into the fume chamber 36 will greatly affect the value and indeed the need for this exchanger.

The heat exchanger 44 inside the insulation of the cell is in the middle temperature zone (900° F. approximately). As will be described in greater detail, it is operated to control the heat flow so that ledges of frozen electrolyte will build to the desired depth on the sides, ends and bottom of the cell.

The heat exchanger 46 under the cover 30 is in the highest heat zone (1700° F. approximately). It is operated to draw that quantity of heat from the surface of the electrolyte as is necessary to maintain the electrolyte at the desired temperature, as described further herein.

In operation, the heat transfer medium, such as air, for example, is passed, in turn, through the heat exchangers 40, 44 and 46 connected in series at an appropriate rate to pick up the desired quantity of heat. A relatively constant flow is required through the heat exchanger 44 in the cell walls to maintain the frozen ridges. However, the heat from the electrolyte to heat exchanger 46 is more variable and is controlled by the bath temperature taken by a pyrometer 48 mounted above the bath 24. Because of these differing heat transfer requirements a portion of the air passing through the heat exchanger 44 can be vented to the atmosphere and atmospheric air can be admitted to the heat exchanger 46, as necessary. A temperature regulator valve 49 at the heat exchanger 46 holds the outlet air temperature between the maximum permitted by the materials of construction and the minimum required by the power generation system.

Figure 2:
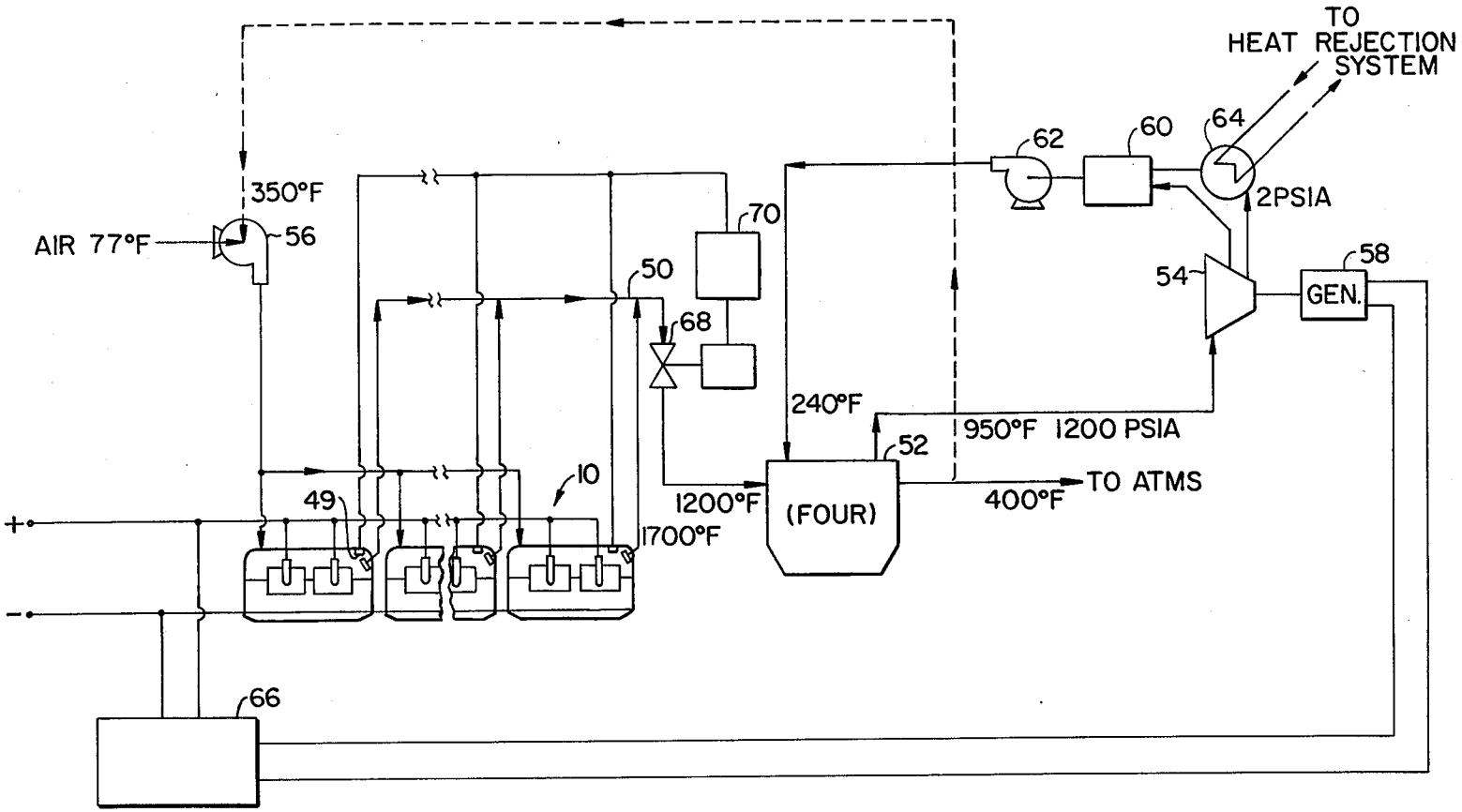
FIG. 2 is a block diagram of the overall system of the invention.

Referring now more particularly to FIG. 2 one example of a system for utilizing the heat recovered by the heat exchangers will be described. The heat exchangers of a single grouping of twenty-two cells of the type shown in FIG. 1 are connected together to provide a supply of heated air which leaves the cells at a temperature of approximately 1300° F. This heated air is conveyed by a piping system 50 to one of four boilers 52. The air, by the time it enters the boilers 52, is approximately 1200° F. In the boilers 52 water is heated from 240° F. to approximately 950° F. at 1200/psia. This high temperature steam is supplied from the four boilers to a steam turbine 54. In one embodiment the air which exits from the boilers 52 is simply exhausted to the atmosphere at approximately 400° F. In a second embodiment of the invention the air is recycled by means of a pump 56, which combines it with make up atmospheric air and returns it to the heat exchangers for reheating.

The steam turbine 54 drives an electrical generator 58 to produce electricity. The condensed hot water from the steam turbine 54 passes to a combining tank 60 and then is pumped back to the boiler at a temperature of 240° by a pump 62. The uncondensed steam from the turbine 54 exits at a pressure of approximately 2/psi. It is fed to a heat rejection system 64 which further condenses the steam to hot water which is supplied to the combining tank 60.

The electrical output from the generator 58 can be supplied to the aluminum reduction facility or can, through appropriate conversion means 66, be fed back to the electrical supply to the reduction cells 10. The electrical conversion means 66 could include appropriate transformers and/or solid state rectifiers.

The ecomonic feasibility of the applicant's invention depends largely on the cost of electric power as well as on the particular production capacity and utilization of the reduction pots.

The material for the heat exchanger 46 should be selected to resist the high temperature and possibly corrosive atmosphere above the molten electrolyte bath. Also, although air was described as the heat transfer fluid for use in the heat exchangers in other systems other fluids would be suitable such as nitrogen and $CO_2$. In still other embodiments liquid heat exchange fluids could be utilized however such fluids must be selected with appropriate safeguards in mind should there be a leak in the heat exchanger over the electrolyte bath.

Also, although the above described embodiment utilized the hot air from the heat exchangers to produce steam, in other embodiments the hot air can be used directly to drive the turbine-generator. The air, on being heated, expands to create a high pressure in the system. This high pressure, high temperature air can then be fed to the turbine.

In order to control the flow rate of the heat transfer fluid, ie. the air within the heat exchanger pipes, and hence to control the rate of heat recovery from each cell 10, a motorized valve 68 is placed in each line 50 between the heat exchangers of each cell and the boiler 52. A servo-valve controller 70 operates each valve 68 in response to a control signal supplied by the optical pyrometer 48 mounted in the cell cover 30.

The pyrometer 48 measures the bath temperature and supplies a corresponding signal to the controller 70. The controller adjusts the valve 68, in servo fashion, to permit a flow rate of the heat transfer fluid which will maintain the operating temperature of the cell within a preset range. As mentioned above, the regulator 49 ensures that outlet air temperature does not fall below the system requirements nor exceeds the limit for the materials of the construction.

The terms and expressions which have been employed here are used as terms of description and not of limitation, and there is no intention, in the use of such terms and expressions of excluding equivalents of the features shown and described, or portions thereof, it being recognized that various modifications are possible within the scope of the invention claimed.

What is claimed is:

1. Improved apparatus for the production of aluminum, the apparatus being of the reduction cell type having a molten electrolyte bath containing dissolved alumina, an open mouthed container for the electrolyte bath, an anode and a cathode immersed in the bath, and means for applying an electric current between the anode and the cathode whereby aluminum is produced and resistance heat is generated, and wherein the improvement comprises thermal insulation surrounding the walls of the container, a refractory cover over the open mouth of the container, a heat exchanger positioned above the molten bath, within the container and beneath the cover for recovering heat from the molten bath, and means, including a temperature sensor for monitoring the electrolyte bath temperature, for selectively controlling the rate of heat recovery by the heat exchanger to maintain the electrolyte bath within a predetermined temperature range, irrespective of limited variations in the supply of electric current to the cell.

2. An improved aluminum production apparatus as recited in claim 1 further comprising means connected to the heat exchanger for converting heat recovered by the heat exchanger into electricity.

3. An improved aluminum production apparatus as recited in claim 2 wherein the heat exchanger contains a heat transfer fluid at a temperature in excess of 1300° F., and wherein the heat to electricity converting means comprise a steam boiler connected to the heat exchanger so that the heat transfer fluid can flow from one to the other whereby steam is produced to a pressure of at least 1200 psia, and a steam-powered electrical generator connected to the boiler so as to be supplied with its steam.

4. An improved aluminum production apparatus as recited in claim 2 wherein the heat to electricity converting means is electrically connected to the means for applying electric current to the anode and cathode of the reduction cell whereby a portion of the generated resistance heat is recovered and is recycled as electrical power.

5. An improved aluminum production apparatus as recited in claims 1 or 2 further comprising an additional heat exchanger positioned in the side and end walls of the cell container to recover heat flow through the container walls and wherein the additional heat exchanger is operatively connected to the heat exchanger positioned above the molten bath.

6. An improved aluminum production apparatus as recited in claim 5 wherein the side and end wall heat exchanger recovers heat at a rate sufficient to keep the surface of the electrolyte molten but to cause ledges of frozen electrolyte to build on the inside surfaces of the side wall, end wall and bottom of the cell.

7. An improved aluminum production apparatus as recited in claim 5 further comprising a fume hood over the top of the cell and an additional heat exchanger beneath the fume hood and above the refractory cover, said heat exchanger being operatively connected to the heat exchanger positioned over the bath.

* * * * *